US009482092B2

(12) United States Patent
Ulaganathan

(10) Patent No.: US 9,482,092 B2
(45) Date of Patent: Nov. 1, 2016

(54) ROTARY INTERNAL COMBUSTION ENGINE

(71) Applicant: Mothinath Ulaganathan, Salem (IN)

(72) Inventor: Mothinath Ulaganathan, Salem (IN)

( * ) Notice: Subject to any disclaimer, the term of this patent is extended or adjusted under 35 U.S.C. 154(b) by 0 days.

(21) Appl. No.: 14/438,622

(22) PCT Filed: Dec. 11, 2012

(86) PCT No.: PCT/IN2012/000813
§ 371 (c)(1),
(2) Date: Apr. 26, 2015

(87) PCT Pub. No.: WO2014/064709
PCT Pub. Date: May 1, 2014

(65) Prior Publication Data

US 2015/0292328 A1 Oct. 15, 2015

(30) Foreign Application Priority Data

Oct. 26, 2012 (IN) ..... 4475/CHE/2012

(51) Int. Cl.

| | |
|---|---|
| ***F01C 1/44*** | (2006.01) |
| ***F01C 11/00*** | (2006.01) |
| ***F01C 21/10*** | (2006.01) |
| ***F01C 1/46*** | (2006.01) |
| *F01C 21/18* | (2006.01) |

(52) U.S. Cl.
CPC . *F01C 1/44* (2013.01); *F01C 1/46* (2013.01); *F01C 11/004* (2013.01); *F01C 21/10* (2013.01); *F01C 21/18* (2013.01)

(58) Field of Classification Search
CPC ..... F01C 1/44; F01C 1/46; F01C 11/004; F01C 21/10; F01C 21/18
USPC ..... 418/6, 61.1, 172, 260, 261, 268, 269
See application file for complete search history.

(56) References Cited

U.S. PATENT DOCUMENTS

| | | | | | |
|---|---|---|---|---|---|
| 3,787,150 | A * | 1/1974 | Sarich | F01C 1/32 | 418/61.1 |
| RE29,230 | E * | 5/1977 | Sarich | F01C 1/32 | 418/151 |
| 4,434,757 | A * | 3/1984 | Walker | F01C 1/44 | 123/241 |
| 5,145,325 | A * | 9/1992 | Terauchi | F04B 27/1804 | 417/222.2 |
| 5,613,838 | A * | 3/1997 | Newell | F03C 1/0607 | 417/269 |
| 6,149,398 | A * | 11/2000 | Fukanuma | F04B 27/0895 | 184/6.17 |
| 6,158,968 | A * | 12/2000 | Nakamura | F04B 27/1072 | 417/222.1 |

(Continued)

*Primary Examiner* — Kenneth Bomberg
*Assistant Examiner* — Dapinder Singh
(74) *Attorney, Agent, or Firm* — Mark M. Friedman

(57) ABSTRACT

A rotary engine has a top housing with suction and exhaust ports and bottom housing arranged to receive a crank assembly and a cam assembly. The crank assembly has a crank plate rotatably placed above the bottom housing and a set of semi circular cranks provided at the top surface of the crank plate to travel along with the crank plate. The cranks are positioned opposite to each other and are aligned to the crank plate. A crank shaft arranged to pass through the top housing and bottom housing drive along with the crank plate. The cam assembly has a set of cams placed above the crank plate and arranged to pivot through pivot pins. The cams and the cranks revolve to form an eccentricity with the outer cavity ring and inner cavity ring. The outer cavity ring is provided to surround the crank above the crank plate and the inner cavity ring is placed inside the cranks such that upon rotation of the crank plate and the cranks, two variable volume outer chamber is formed in between the cranks and the outer cavity ring, and two variable volume inner chamber is formed in between the cranks and the inner cavity ring.

18 Claims, 14 Drawing Sheets

(Present Invention)

(56) References Cited

U.S. PATENT DOCUMENTS 6,386,838 B2 * 5/2002 Hoyt ..... F01C 9/002
123/18 A 6,607,371 B1 * 8/2003 Raymond ..... F01C 1/34
418/11

2003/0131808 A1 * 7/2003 Al Hawaj ..... F01B 13/04
123/44 B

* cited by examiner (Present invention)

(Present invention)

(Present invention)

(Present invention)

(Present invention)

(Present invention)

(Present invention)

(Present invention)

(Present invention)

(Present invention)

(Present invention)

(Present invention)

(Present invention)

(Present invention)

(Present invention)

ROTARY INTERNAL COMBUSTION ENGINE

FIELD OF INVENTION

The present invention relates to rotary engines, and more particularly to a rotary engine having a crank assembly eccentrically arranged to form a set of outer chambers for compression and a set of inner chambers for combustion, and completing two power cycles within one revolution.

BACKGROUND OF THE INVENTION

The conventional internal combustion engine having reciprocal movements of the pistons and such reciprocation of pistons translated into rotation of a crankshaft via special transduction means, are well known. However, the conventional engines suffer major drawbacks such as low fuel efficiency coefficient due to losses on friction of slide between pistons and cylinders walls and transduction of reciprocal-to-rotational motion, thus excessive vibrations due to imbalances in the whole piston transduction mechanism-crankshaft system. The conventional engine requires many accessory mechanisms and thus they are heavy in weight and higher in cost.

In order to overcome the drawbacks of the conventional reciprocating internal combustion engines, rotary internal combustion engines are introduced. The rotary engines are developed as an alternative to the conventional reciprocal internal combustion engine and to deliver increased fuel efficiency. In the rotary internal combustion engine the energy of expanding gasses directly drives the rotation of the shaft. However, most of the existing models apparently suffer either from excessive complexity translatable into high weight and cost of production or do not provide notable gains in the efficiency coefficient.

The existing rotary engines also suffer from problems such as poor fuel efficiency and engine performance. Moreover, in many rotary type engines the structure is complex due to many components and tangled intrinsic system of gas conduits, and thus manufacturing costs become high. The reliability and durability of gas sealing mechanisms in the existing technical solutions also remains the matter of concern. Thus, simple and yet reliable model of rotary engine that would attract manufactures attention still remains a priority.

Therefore, it is necessary to provide an improved rotary type internal combustion engine which is capable to address and overcome the above disadvantages of conventional engines. Accordingly it is desirable to provide an improved rotary type internal combustion engine which is simple, compact and reliable model and providing an improved fuel efficiency and increased engine performance.

OBJECT OF THE INVENTION

The main object of the present invention is to provide an improved rotary type internal combustion engine which address and overcomes the disadvantages of conventional engines.

Another object of the present invention is to provide an improved rotary type internal combustion engine which provides improved fuel efficiency and increased engine performance.

Another object of the present invention is to provide an improved rotary type internal combustion engine which is simple and compact.

Another object of the present invention is to provide a rotary engine which completes two cycles within one revolution, and thereby improving the fuel efficiency and engine performance.

SUMMARY OF THE INVENTION

The present invention which achieves the objective relates to a rotary type internal combustion engine having a top housing constructed with air ports for suction and exhaust for the engine and a bottom housing aligned with the top housing. The bottom housing is arranged to receive a crank assembly and a cam assembly such that the crank assembly and cam assembly are assembled in between the top housing and the bottom housing. A crank plate is rotatably placed above the bottom housing through a bearing and a set of semi circular cranks are provided at the top surface of the crank plate to travel along with the crank plate.

A crank shaft is arranged to drive along with the crank plate and the cranks are positioned opposite to each other and are aligned to the crank plate. The cam assembly has a set of cams placed above the crank plate, such that the cams are guided by the cranks to revolve with the crank plate. The cams are formed with a profile such that the radius of the cams aligns with the cranks provided in the crank plate. The outer radius of the cam is always in contact with the inner wall of the outer cavity ring and the inner radius of the cam is always in contact with the outer radius of the inner cavity ring.

An outer cavity ring is placed above the crank plate is arranged to surround the crank plate and an inner cavity ring is placed at the inner side of the cranks. The cranks and the crank plate are arranged such that the center of the crank plate is having an offset with the outer cavity ring and the inner cavity ring, and the centre of the circular orbit formed by the semi circular cranks and the center of the crank plate is concentric with each other. The centre point of the crank assembly is made offset with respect to the centre of the top casing and bottom casing assembly. Thus upon rotation of the crank plate and the cranks, two variable volume outer chamber for compression is formed in between the cranks and the outer cavity ring, and two variable volume inner chamber for combustion is formed in between the cranks and the inner cavity ring.

A set of pivot pins supported from the crank plate are provided to enable pivoting of the cams. The cams and the pivot pins are provided with grooved air paths to transfer the received compressed air through the air paths in the pivot pins. A set of sealed air guide paths are formed at the bottom of the crank plate and the cranks to communicate the compression air chambers formed in between the cranks and the outer cavity ring to the combustion chambers formed in between the cranks in the crank plate and the inner cavity ring. A set of air and fire actuators are placed at the air guide path of the crank plate to channelize the compressed air from the compression air chambers to the combustion chambers through the air paths provided in the crank plate. The air and fire actuators are provided in the air paths of the crank plate such that upon reaching a predetermined position, the air actuator is getting actuated in the bottom casing and the fire actuator is actuated in the top casing through the grooves in the top and bottom casing and the air from the air paths are allowed to pass through the air paths in the crank plate.

The air enters into the compression chamber through the suction ports provided in the top housing, and the rotation of the crank plate and the cams compresses the air in the compression chambers. The rotation of the crank plate and the actuation of the air and fire actuator allow the compressed air to pass through the air paths in the crank plate. The further rotation of the crank plate actuates the roller of the air and fire actuator and allows passing the compressed air to the combustion chamber through the air paths in the crank plate, crank, cams and the pivot pins. A set of spark plugs are provided for the combustion chambers through the crank plate, such that the spark plug rotate along with the crank plate and is activated at the desired position by making it to pass through the ignition path that is given in the bottom housing. The spark plug ignites the compressed charge inside the combustion chambers and this combustion delivers power which results in driving of the crank plate and the crank shaft. The further driving of the crank plate actuates the exhaust port to exhaust the combusted gases inside the combustion chamber.

The actuation of the crank shaft draws the air through the suction port in one compression chamber and compressed air is transferred through the air paths to the combustion chamber. The crank assembly is arranged such that two outer compression chamber and two inner combustion chambers are formed, thus within one revolution the engine completes two cycles or one cycle of operation is done within half the revolution. The opening and closing of the air paths are controlled by the air and fire actuator as it passes through the predetermined position in the top and bottom housing, thus the opening and closing of air paths can be easily controlled.

The rotary engine according to the present invention can be utilized as a petrol engine by placing the spark plugs in the crank plate and configuring the spark plugs to ignite the combustion chamber upon actuation of the air and fire actuators. This engine can be used as a diesel engine by replacing the spark plugs with the fuel injectors. The ignition system can also be placed in the top casing, and the timing arrangement for the ignition system is must be coupled.

This rotary engine can also be used as an air compressor by channelizing and storing the compressed from the compression chambers. Thus the rotary engine according to present invention can be adopted for petrol engine, diesel engine and as an air compressor. The rotary engine can be adopted as an alternate to the piston cylinder application like engine, pump, compressor etc.

BRIEF DESCRIPTION OF DRAWINGS

Referring now to the drawings wherein the showings are for the purpose of illustrating a preferred embodiment of the invention only, and not for the purpose of limiting the same.

DETAILED DESCRIPTION

The present invention relates to rotary engines, and more particularly to a rotary engine having a crank assembly arranged to form a set of outer chambers for compression and a set inner chambers of combustion, thereby completing two power cycles within one revolution.

Figure 1:
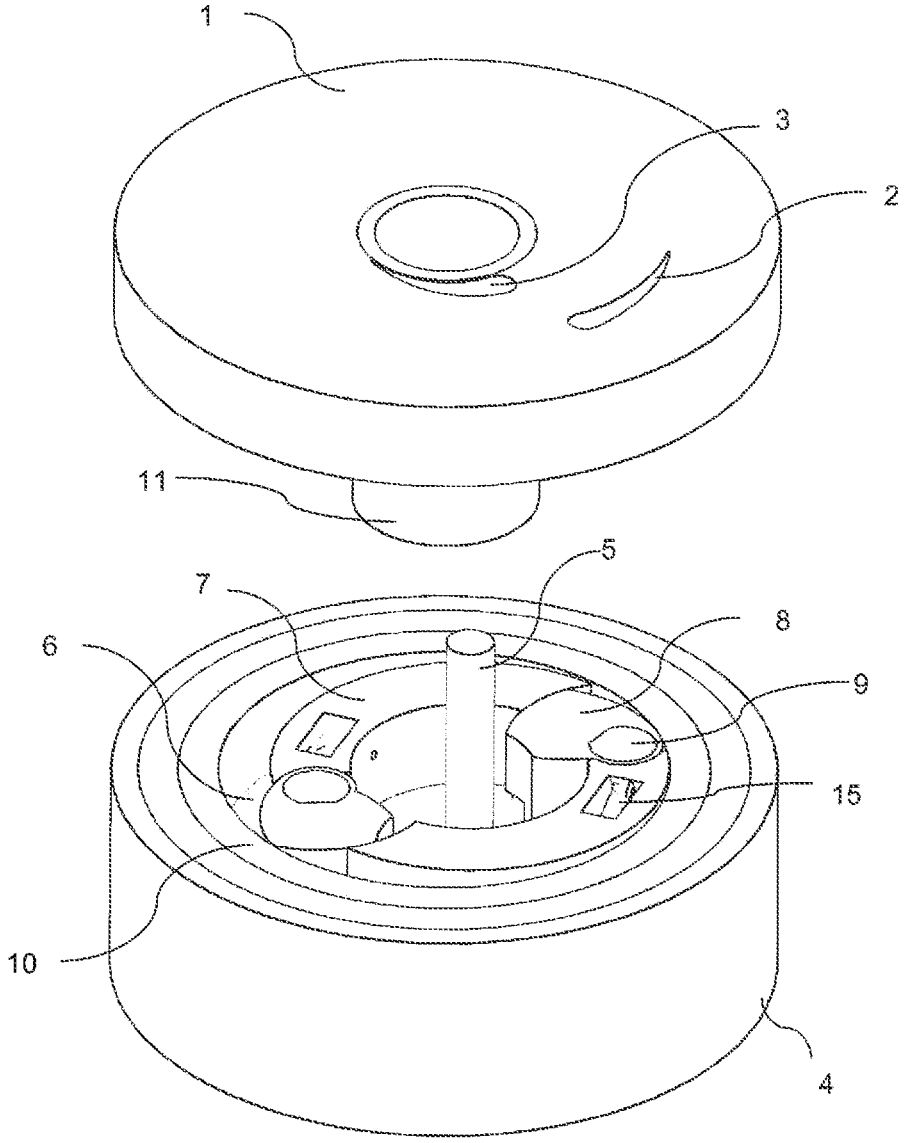
FIG. 1 shows an assembly perspective view of the rotary internal combustion engine in accordance to the exemplary embodiment of the present invention.

FIG. 1 shows an assembly perspective view of the rotary internal combustion engine in accordance to the exemplary embodiment of the present invention. The rotary type internal combustion engine has a top housing (1) constructed with air ports for suction (2) and exhaust (3) for the engine. A bottom housing (4) is constructed and assembled to align with the top housing (1) of the rotary engine. The bottom housing (4) is arranged to receive a crank assembly and a cam assembly such that the crank assembly and cam assembly are assembled in between the top housing and the bottom housing.

A crank shaft (5) transmitting the output from the engines is assembled to the crank plate (6) such that the crank shaft drives along with a circular crank plate (6). The top housing (1) and the bottom housing (4) are assembled to form a leak proof engine assembly. Necessary cooling circuit and oil seals are provided for cooling and lubricating all the parts of the engine. The crank assembly has a crank plate (6) rotatably placed above the bottom housing (4) through a bearing placed inside the bottom housing (4). The crank plate (6) is supported through its bottom surface through a bearing. A set of semi circular cranks (7) are arranged at the top surface of the crank plate (6) to travel along with the crank plate. An outer cavity ring (10) is provided to surround on top of the crank plate (6) and an inner cavity (11) ring is placed at the inner side of the semi circular cranks (7). The cranks are positioned opposite to each other and are aligned to the crank plate (6) to form a circular orbit. The semi circular cranks (7) and the crank plate (6) are arranged such that the center of the cranks (7) is having an offset with the centre of the outer cavity ring (10) and center of the inner cavity ring (11). The centre of the circular orbit formed by the semi circular cranks (7) and the center of the crank plate (6) are made concentric with each other.

The centre point of the crank assembly is made offset with respect to the centre of the top casing (1) and bottom casing assembly (4). The cranks (7), cam assembly and the crank plate (6) are perfectly balanced through necessary balancing mechanism (not shown) for reducing the vibrations in the engine. The cranks (7) are fixed onto the crank plate such that its inner wall touches the outer wall of inner cavity ring (11) and outer wall of the crank (7) touches the inner wall of the outer cavity ring (10). The cranks (7) and the crank plate (6) revolve to form an eccentricity with the rings (10) and (11) which enables to form variable volume chambers inside the rotary engine.

The cam assembly has a set of cams (8) placed above the crank plate (6), such that the cams (8) and the cranks (7) rotate to form an eccentricity with respect to top housing (1), bottom housing (4), inner ring (11) and outer ring (10). The cams (8) are formed with profile such that the radius of the cams (8) aligns with the cranks (7), inner cavity ring (10) and the outer cavity ring (11). A set of pivot pins (9) supported from the crank plate (6) are provided to provide pivoting and of cam (8). The cams (8) and the pivot pins (9) are provided with grooved air paths to transfer the received compressed air through the pivot pins.

Figure 2:
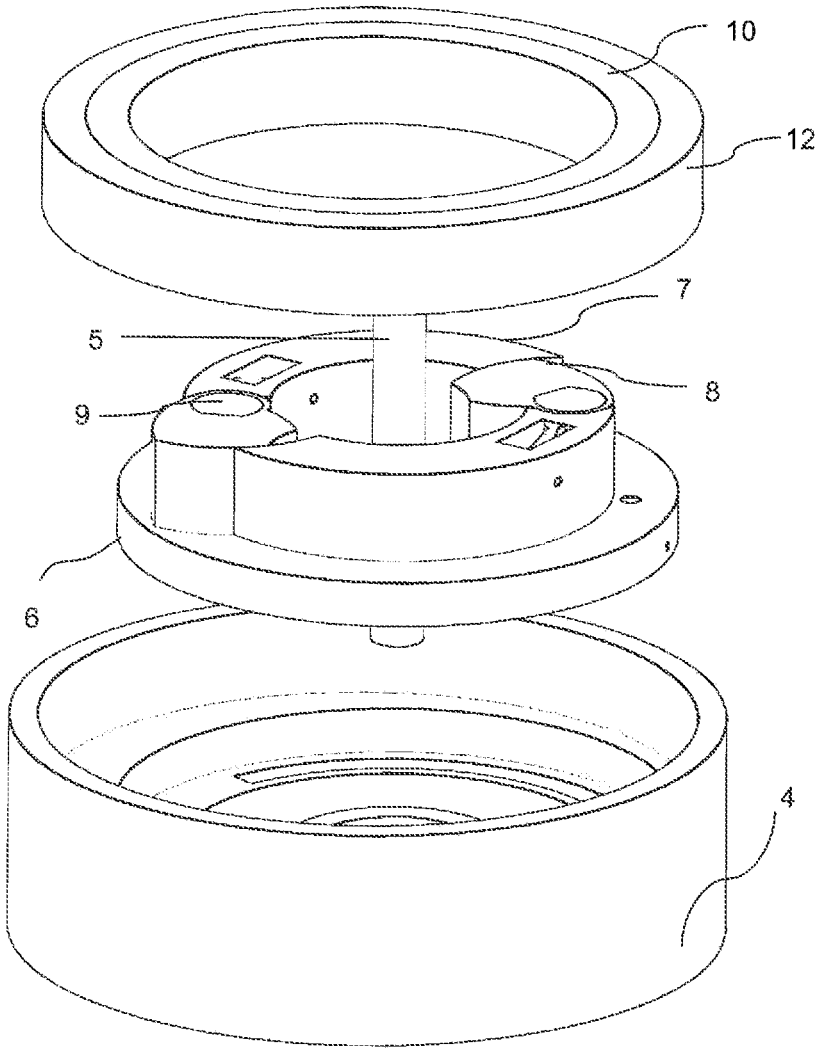
FIG. 2 shows an exploded view of the bottom assembly, in accordance to the exemplary embodiment of the present invention.

FIG. 2 shows an exploded view of the bottom assembly, in accordance to the exemplary embodiment of the present invention. The bottom housing (4) of the rotary engine has provisions to rotatably accommodate the crank plate (6) through the circular bearing. The bottom surface of the crank plate (6) has a boss extended at its centre through which the crank shaft (5) is placed to drive along with the crank plate (6). The external side of the crank plate boss is arranged to mount on the bottom housing (4) through the bearing provided at the inside surface of the bottom housing.

The outer cavity ring (10) is placed inside the bottom housing (4) in the bearing (12) to surround the cranks (7) such that upon rotation of the cranks (7) and the crank plate (6), two variable volume outer chambers for compression is formed in between the cranks (7) and the outer cavity ring (10). The bottom housing (4) of the engine has provisions to receive and accommodate the outer cavity ring (10) in between the cranks (7) and the circumferential face of the bottom housing (4). The inner cavity ring (11) is placed inside the cranks (7) to surround the crank shaft (5), such that, upon rotation of the crank plate (6) and the cranks, two variable volume outer chambers for combustion is formed in between the cranks (7) and the inner cavity ring (11). The pivot pins (9) are placed with the crank plate (6) to pivot the cams (8) in the cam assembly.

An eccentric is formed between the crank assembly and inner and outer cavity rings (10) and (11) which are placed inside their respective housing. In order to have the complete sealing of air inside the compression and combustion chamber, the face of the crank plate (6) is bigger to compensate the gap formed due to the offset with respect to the inner and outer cavity rings (10) and (11). The semicircular cranks (7) are arranged such that, on the bottom it is fixed with the crank plate (6) on the top it slides on the inner bottom surface of the top housing (1). The two semicircular cranks (7) are placed opposite to each other over the crank plate (6) forms a circular path with gap of equal distance.

The outer radius of the cranks (7) touches the inner radius of the outer cavity ring (10) at only one point and similarly the inner radius of the cranks (7) touches the outer radius of the inner cavity ring (11) at one position with respect to the offset of the cranks (7). The outer radius on both the side of the cranks (7) is made accurately to slide on the outer and inner rings (10) and (11), and guide the cams (8) which oscillate on its pivot position. The cranks (7) are fixed on top of the crank plate (6) and made to revolve along with the crank plate (6) in concentric to the crank plate and with an offset on one axis with respect to the inner and outer cavity rings (10) and (11).

The cam (8) has radius on four sides, and a pivot projection along with air path on its bottom. The cam (8) is placed in bearing in the crank plate (6) by its pivot projection and it oscillates on the surface of the crank plate (6) and guided by semi circular cranks (7) on both sides and the other two radiuses slides on the inner cavity ring (10) and the outer cavity ring (11). The top surface of the cam (8) slides on the bottom face of the top housing (1). A set of spark plugs (not shown) are provided for the combustion chambers at the crank plate (6) to ignite the compressed charge inside the combustion chambers and this combustion delivers power which results in driving of the crank plate (6) and the crank shaft (5). The further rotation of the crank shaft (5) and the crank plate (6) actuates the exhaust port to exhaust the combusted gases inside the combustion chamber.

Figure 3:
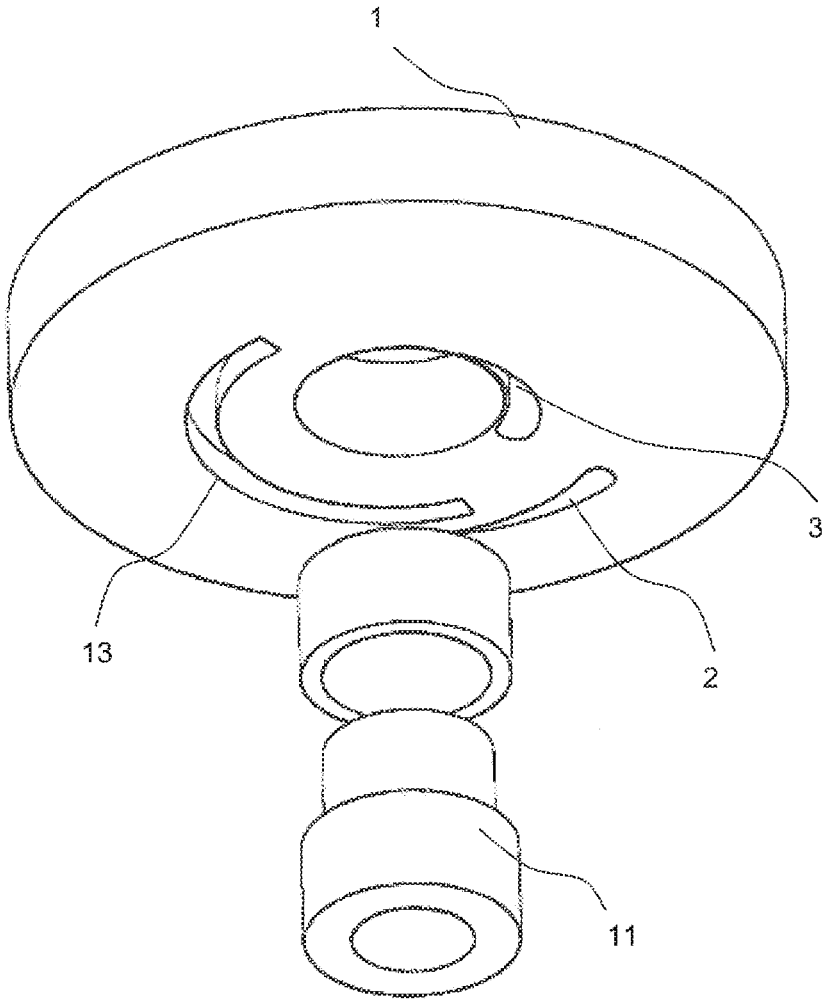
FIG. 3 shows an exploded view of the top assembly, in accordance to the exemplary embodiment of the present invention.

FIG. 3 shows an exploded view of the top assembly, in accordance to the exemplary embodiment of the present invention. The top housing (1) is provided with suction ports (2) and exhausts ports (3) for enabling suction and exhaust process for the engine. The suction and the exhaust ports are arranged with the top housing (1) to perfectly align with the compression chambers and combustion chamber forming inside the engine. The suction ports (2) and the exhaust ports (3) are provided with required induction and exhaust lines to carry out the compression and combustion process. The air enters into the compression chamber through the suction ports (2) provided in the top housing (1), and the rotation of the crank plate (6) and the cranks (7) with cam (8) compresses the air in the compression chambers. A groove (13) is provided at the inner surface of the top housing (1) for actuation of the air and fire actuator (15).

Figure 4:
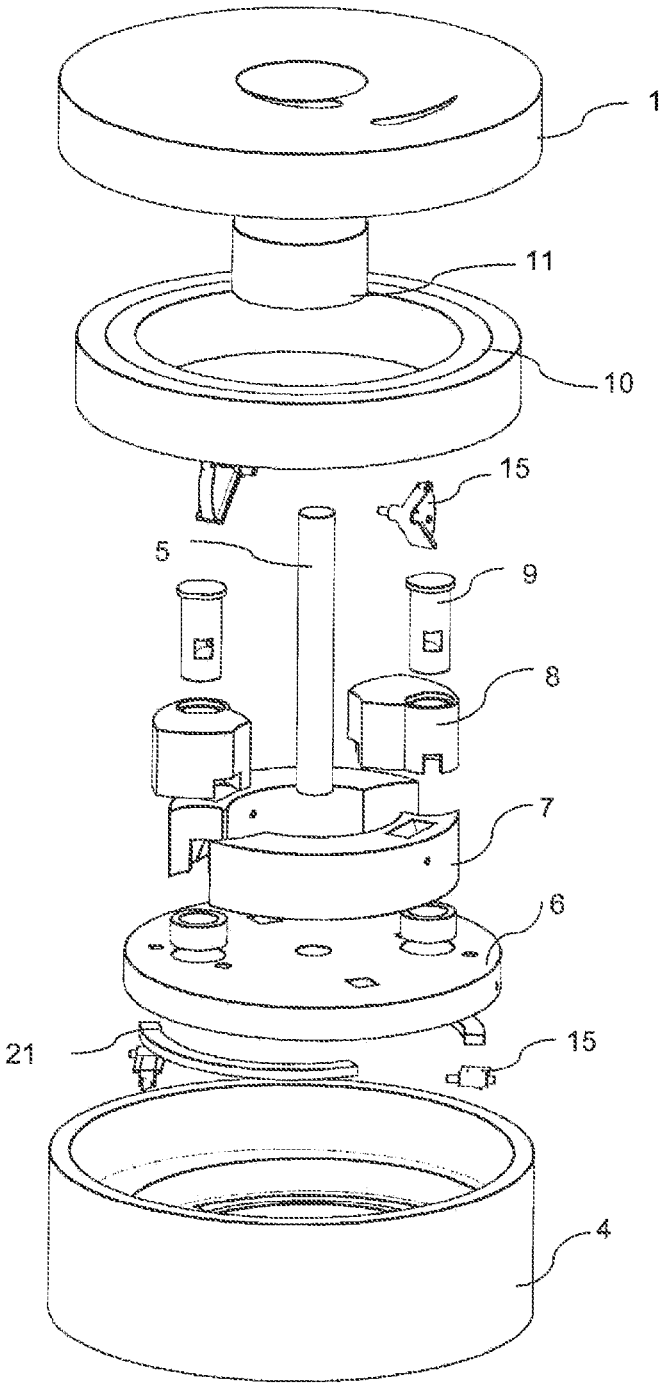
FIG. 4 shows an exploded view of the crank assembly and the cam assembly, in accordance to the exemplary embodiment of the present invention.

FIG. 4 shows an exploded view of the crank assembly and the cam assembly, in accordance to the exemplary embodiment of the present invention. The crank plate (6) has provisions to accommodate the pivot pins (9) for the cams (8) such that the cams oscillate in the cranks (7). The pivot pin (9) arranged with the cam (8) is further inserted into crank plate (6) provided with bearing, for making the cam to oscillate. A set of sealed air guide paths (16) are formed at the bottom of the crank plate (6) and the cranks (7) to communicate the compression air chambers formed in between the cranks and the outer cavity ring (10) to the combustion chambers formed in between the cranks (7) and the inner cavity ring (11). The cranks (7) are provided with air path (19) which acts as a storage point for the compressed air. The air guide path is sealed through seal units (21) to have a perfect leak proof system.

The air and fire actuators (15) are placed at the air guide path (16) of the crank plate (6) to travel along the air guide path at the bottom housing (4) and to channelize the compressed air from the compression air chambers to the combustion chambers through the air paths provided in the crank plate (6). The air and fire actuators (15) are provided in the air paths (16) of the crank plate (6) such that upon reaching a predetermined position, the air and fire actuators (15) are actuated. The crank assembly is arranged such that two outer compression chamber and two inner combustion chambers are formed, thus within one revolution the engine completes two cycles or one cycle of operation is done within half the revolution. The opening and closing of the air paths (16) are controlled by the air and fire actuators (15), thus the opening and closing of air paths can be easily controlled. The spark plugs are configured to ignite the combustion chamber upon actuation.

Figure 5:
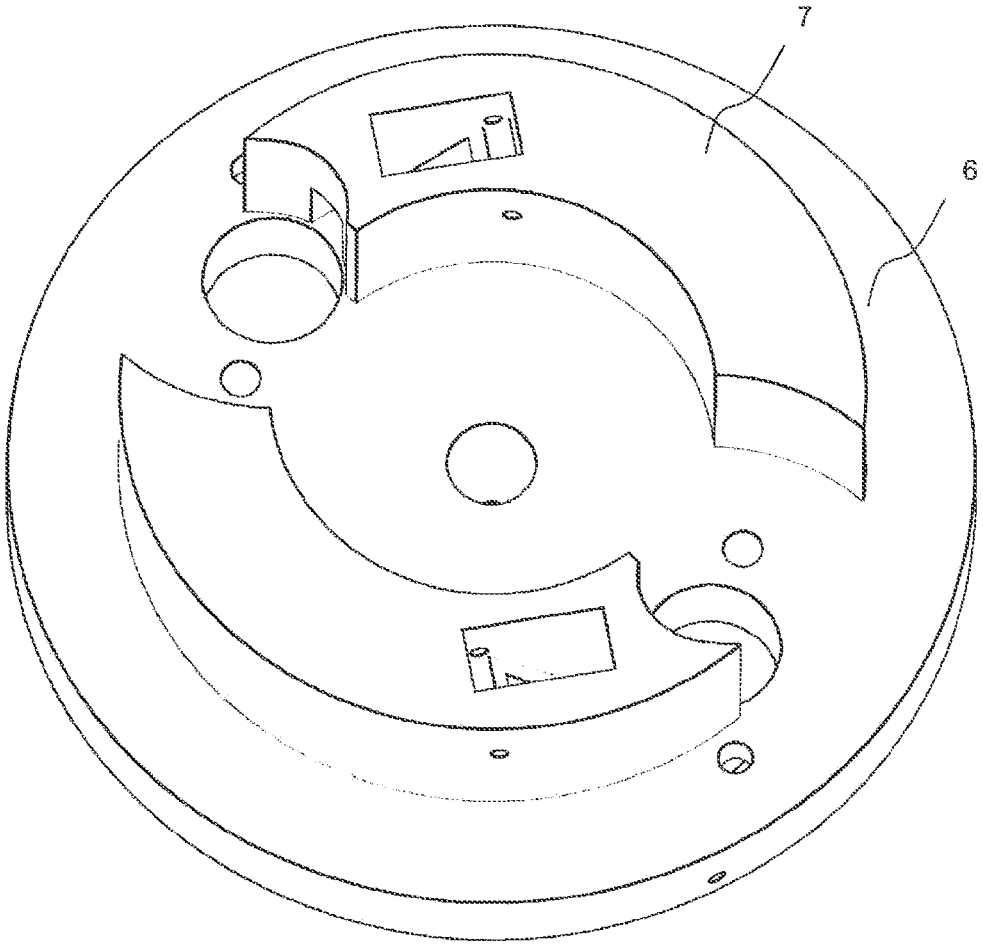
FIG. 5 shows a view of the crank assembly having crank plate and semi circular cranks arranged on the crank plate, in accordance to the present invention.

FIG. 5 shows a view of the crank assembly having crank plate and semi circular cranks arranged on the crank plate, in accordance to the present invention. The crank plate (6)

and the (7) cranks are provided in between the top housing (1) and the bottom housing (4). The semi circular cranks (7) are assembled with the crank plate (6) to revolve along with the crank plate (6). The cranks (7) are placed on the crank plate such that the centre of the outer cavity ring (10) and the inner cavity ring (11) is having an offset with the center of the circular orbit formed by the semi circular cranks (7) placed on the crank plate (6). This offset between the centers forms an eccentricity with the cranks such that upon rotation of the cranks (7) in between the outer cavity ring (10) and the inner cavity ring (11), two outer compression chambers and two inner combustion chambers are formed. The crank plate (6) has provisions to mount the pivot pins (9).

Figure 6:
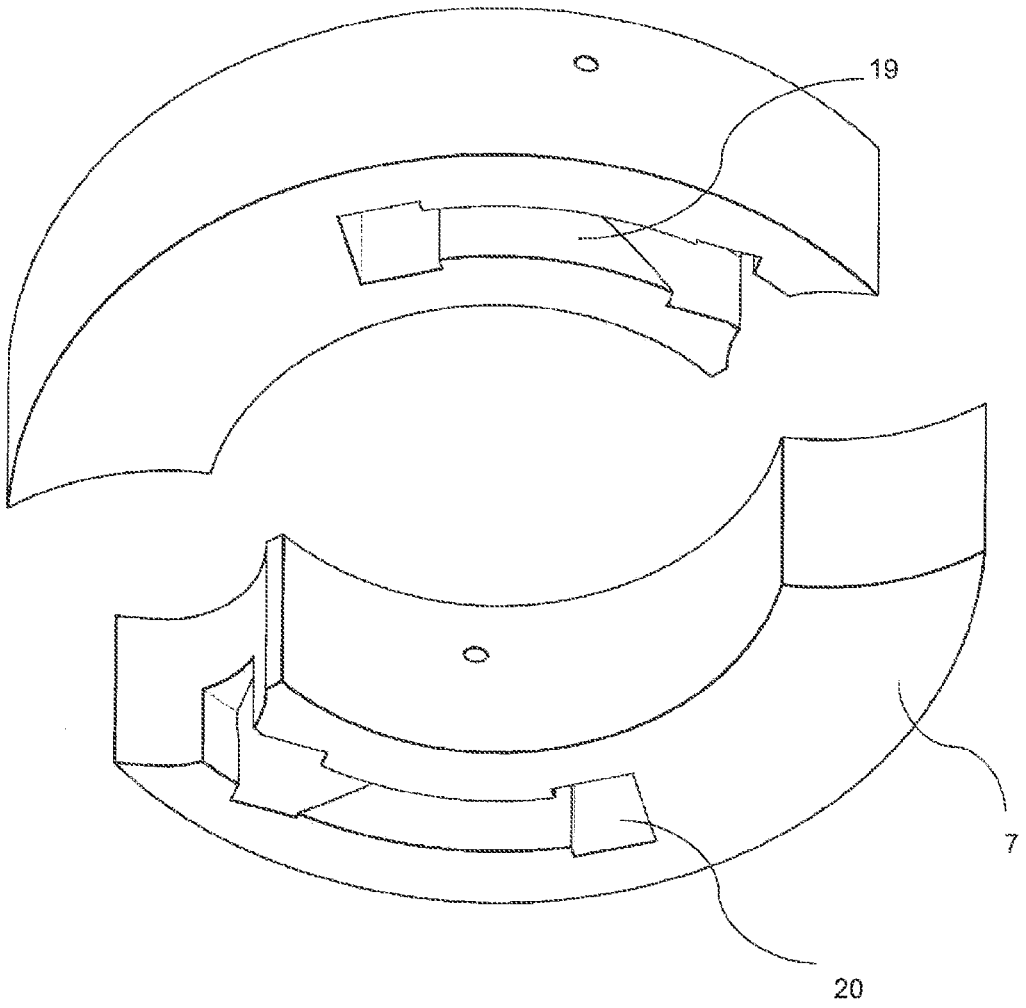
FIG. 6 shows the bottom view of the cranks having air guide paths, in accordance to the present invention.

FIG. 6 shows the bottom view of the cranks having air guide paths, in accordance to the present invention. The cranks (7) are provided with air guides grooves (19) at its bottom surface to communicate the compressed air from the compression chamber to the combustion chamber through the air guide paths (16) in the crank plate (6). A square cut out (20) made with the cranks (7) at the air guide grooves (19) of the cranks (7) transmit the compressed air from the compression chamber to the combustion chamber through the crank plate (6). Upon rotation of the crank plate (6), the compression process takes place in the compression chamber formed in between the outer cavity ring (10) and the cranks (7), and the air compressed in the compression chamber is transferred through this air guide grooves (19) in the cranks (7).

Figure 7:
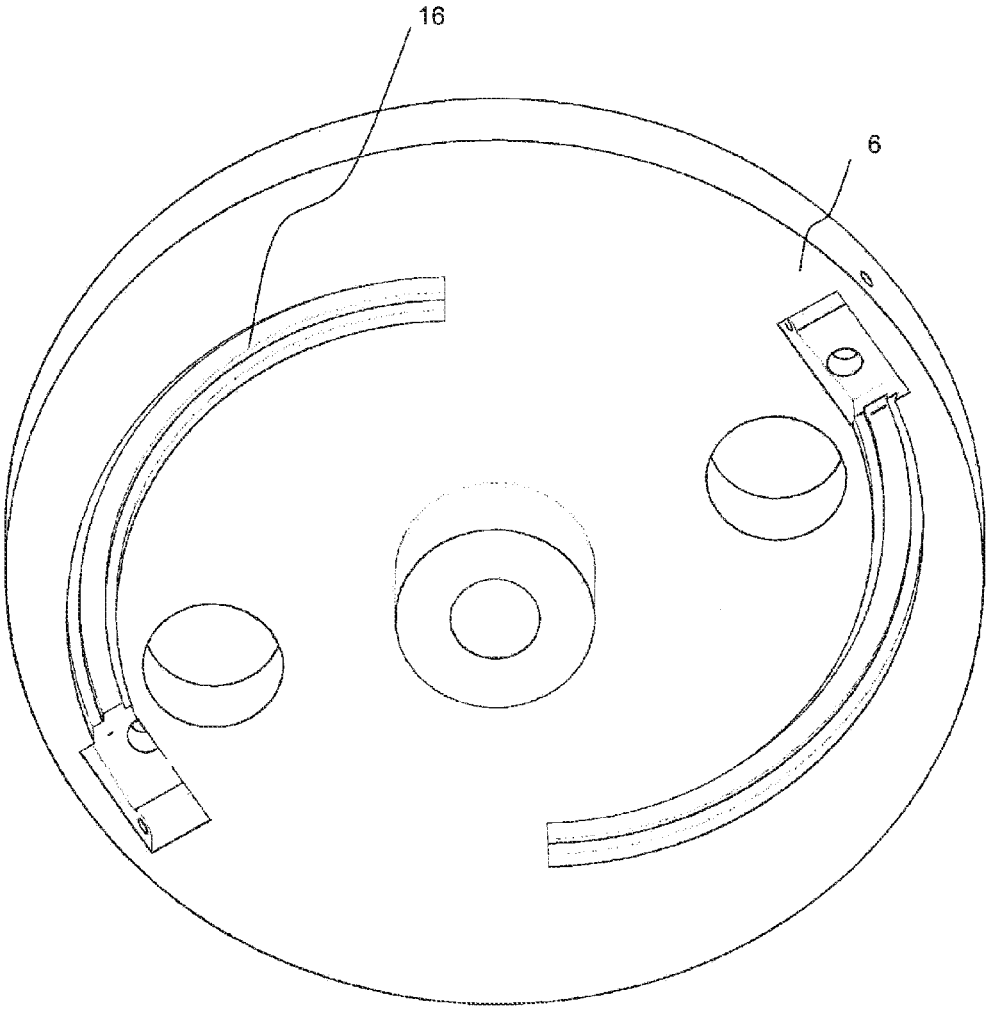
FIG. 7 shows the bottom view of the crank plate having air guide paths in accordance to the present invention.

FIG. 7 shows the bottom view of the crank plate having air guide paths in accordance to the present invention. The bottom side of the crank plate (6) is formed with air guide paths (16). The air guide paths (16) are formed to store and transmit the compressed air from the compression chamber to the combustion chamber. The air and fire actuators (15) and the pivot pins (9) are arranged to assemble with the crank plate (6) such that the compressed air from the compression chamber formed in the outer side of the crank assembly is drawn through the air guide (16) in the crank plate (6). The air guide path is sealed through seal units (21) to have a perfect leak proof system. The air and fire actuators (15) provided in the crank plate (6) to control the transfer of the compressed air to the air guide path (16) in the crank plate (6).

Figure 8:
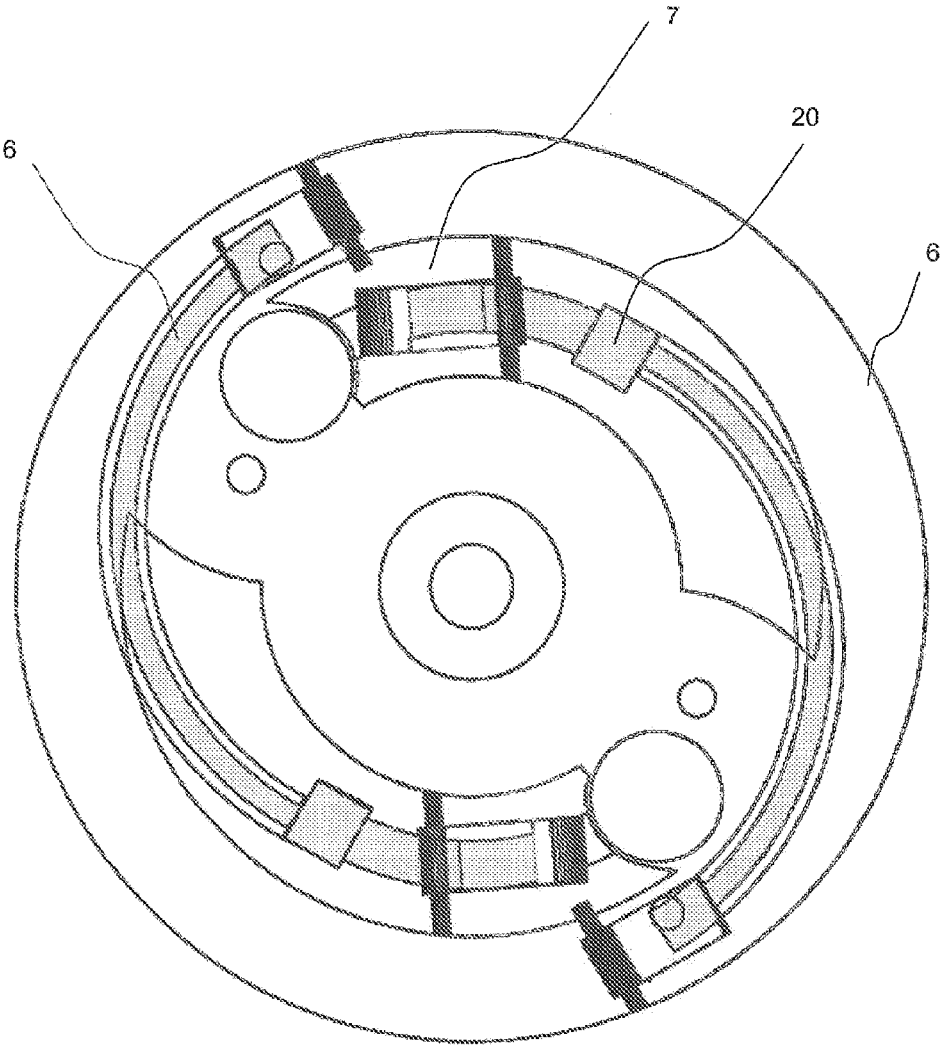
FIG. 8 shows a view of the crank plate illustrating the air guide path, in accordance to the present invention.

FIG. 8 shows a view of the crank plate illustrating the air guide path, in accordance to the present invention. The rotation of the crank plate (6) and the actuation of the air and fire actuators (15) allow passing the compressed air to the air paths (16) in the crank plate (6). To prevent air entrapment groove (not shown) is provided on top of the crank plate (6). The further rotation of the crank plate (6) actuates the roller of the air and fire actuators (15) and allows passing the compressed air to the combustion chamber through the air paths (16) in the crank plate (6), crank (7), cams (8) and the pivot pins (9). The actuation of the crank shaft (5) draws the air through the suction port (2) in one compression chamber and the compressed air is transferred through the air paths (16) to the combustion chamber.

Figure 9A:
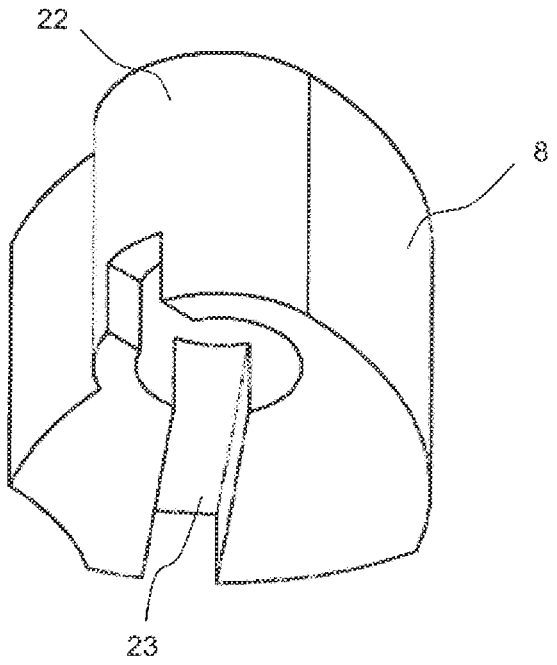
FIG. 9*a* shows a view of the cam having radius profile to align with the cranks, in accordance to the present invention.
Figure 9B:
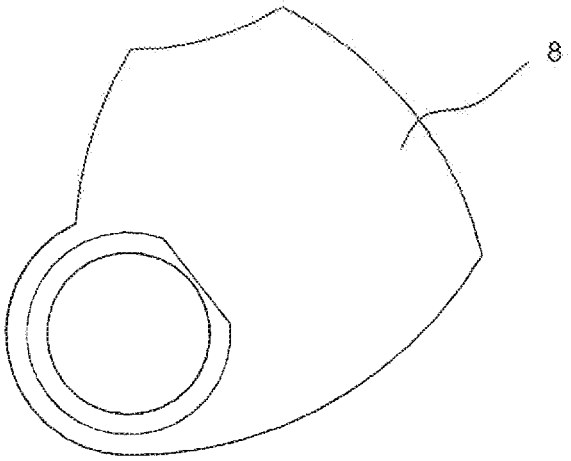
FIG. 9*b* shows the top view of the cam guiding the cranks, in accordance to the present invention.

FIGS. 9*a* and 9*b* shows an isometric view and the top view of the cam, in accordance to the present invention. The cams (8) are formed with a curved profile such that the radius (22) of the cams (8) aligns with the cranks (7) in the crank plate. The cams are designed to align with the cranks (7) to closely contact with the cranks and revolve with the crank plate (6). The cams are pivoted through the pins (9) provided in the crank plate (6) such that the cams (8) oscillate during the revolution in the crank plate (6). The bottom surface of the cams are provided with an air path (23) to receive the compressed air from the air guide paths (16) in the crank plate (6) and transfer the air to the combustion through the air paths (23) provided in the cams (8). The radius of the cam (8) is perfectly angled and guided between cranks (7) and made to oscillate at a pivot point perfectly aligned between inner cavity ring (10) and outer cavity ring (11) thereby providing complete sealing between compression and suction and also combustion and exhaust.

Figure 10:
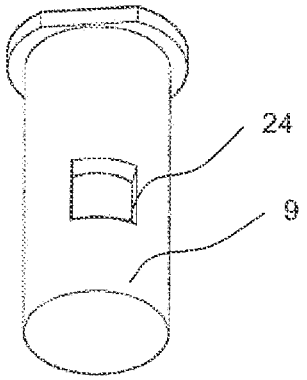
FIG. 10 shows a view of the pivot pin for pivoting and oscillating the cams, in accordance to the present invention.

FIG. 10 shows a view of the pivot pin for pivoting and oscillating the cams, in accordance to the present invention. The pivot pins (9) are arranged with the crank plate (6) to pivot the cams (8) placed with the crank plate. The cams (8) are mounted through the pivot pins to oscillate through the pivot pins. The pivot pins (9) are constructed with a hollow portion inside to receive the roller (17) of the air and fire actuator (15). The pivot pins (9) have air path (24) provisions to transfer the air inside the pivot pins (9). The pivot pins act as a channel to communicate the compressed air from the air guide path (16) in the crank plate (6) to the combustion chamber through the air and fire actuator (15).

Figure 11A:
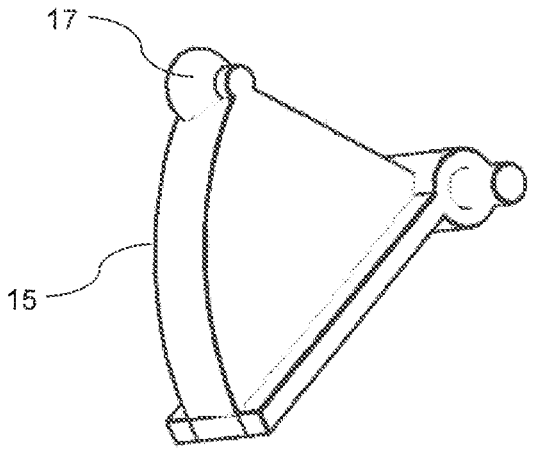
FIGS. 11*a* and 11*b* shows the various views of the air and fire actuators having pivot at V joint, in accordance to the present invention.
Figure 11B:
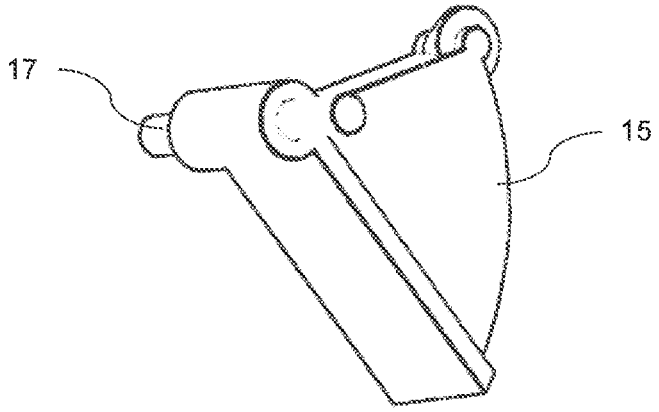

FIGS. 11*a* and 11*b* shows the various views of the air and fire actuator, in accordance to the present invention. The air and fire actuator are provided with the crank plate (6) and are supported through the spring placed in the crank plate (6). The roller (17) of the air and fire actuators (15) is actuated through the spring arranged on the crank plate (6). The air and fire actuator (15) is aligned with the groves in the housing (1) such that upon reaching a predetermined position the actuators (15) are get actuated and the compressed air from the air guide paths (16) in crank plate (6) are transferred to the combustion chamber.

The air and fire actuator (15) is a cam with roller (17) on one side and pivot point on the other. When the actuator (15) is in closed condition it doesn't allow the air to pass through the air path (16) and it is actuated when it passes through the groove in the housing. The opening of the air and fire actuator is actuated by the spring (not shown) in the crank plate (6). The actuator (15) is made of single piece and is arranged to move up and down through the spring in the crank plate.

In operation, the crank shaft (5) connected to the crank plate (6) is driven initially by external source like motor. This driving force makes rotation of the crank plate (6) and the cranks (7) on specified path touching the inner wall of the outer cavity ring (10) and outer wall of the inner cavity ring (11). When the cranks (7) rotate, the pivoted cam (8) which is free to oscillate is guided by the crank (7) and the equidistance path formed between inner and outer rings. Since the centre of the crank assembly is made offset with respect to the centre of the rings (10, 11), and the cranks are made to revolve within the inner and outer rings, one inner and one outer chamber are formed.

The suction port (2) is aligned at a position on the top casing (1), such that when the crank shaft (5) is driven by external source the cam (8) passes the suction port. When the cam (8) passes the suction port (2) the air trapped inside the compression chamber gets compressed. The compression chamber is now simultaneously drawing air inside the chamber. At the determined position the air path (16) is opened by air and fire actuator (15) provided under the crank plate (6) by the spring as soon as it passes through the groove (13) in the bottom housing. The compressed air starts storing in the air path provided in the crank plate (6) with air sealant and to the crank (7) through the square opening (20) provided on top of the crank plate (6). Upon further rotation of the crank plate (6) the compressed air in the compression chamber gets transferred to the combustion chamber. The firing takes place for almost half of the cycle. In order to prevent any error of overlapping of operation minimum angle of interval is provided to start refilling the chamber after combustion. As the cam (8) reaches the end point of the compression chamber the air and fire actuator (15) closes transfer of the compressed air through the air guide path (16) in the crank plate (6).

The combustion chamber is formed by the semicircular cranks (7), cam (8), inner cavity ring (10), top housing (1) and the crank plate (6). This point is zero for our operation. From point zero when the crank (7) continues to rotate 3 degree to 5 degree, the air and fire actuator (15) gets actuated and compressed air and fuel mixture fills in the chamber. When the fire actuator (15) is actuated the air stored in the air guide path (19) of the crank (7) is transferred to the combustion chamber. Simultaneously the spark plug which is placed beneath the cam (8) in the crank plate (6) is activated and firing takes place in the combustion chamber.

Figure 12:
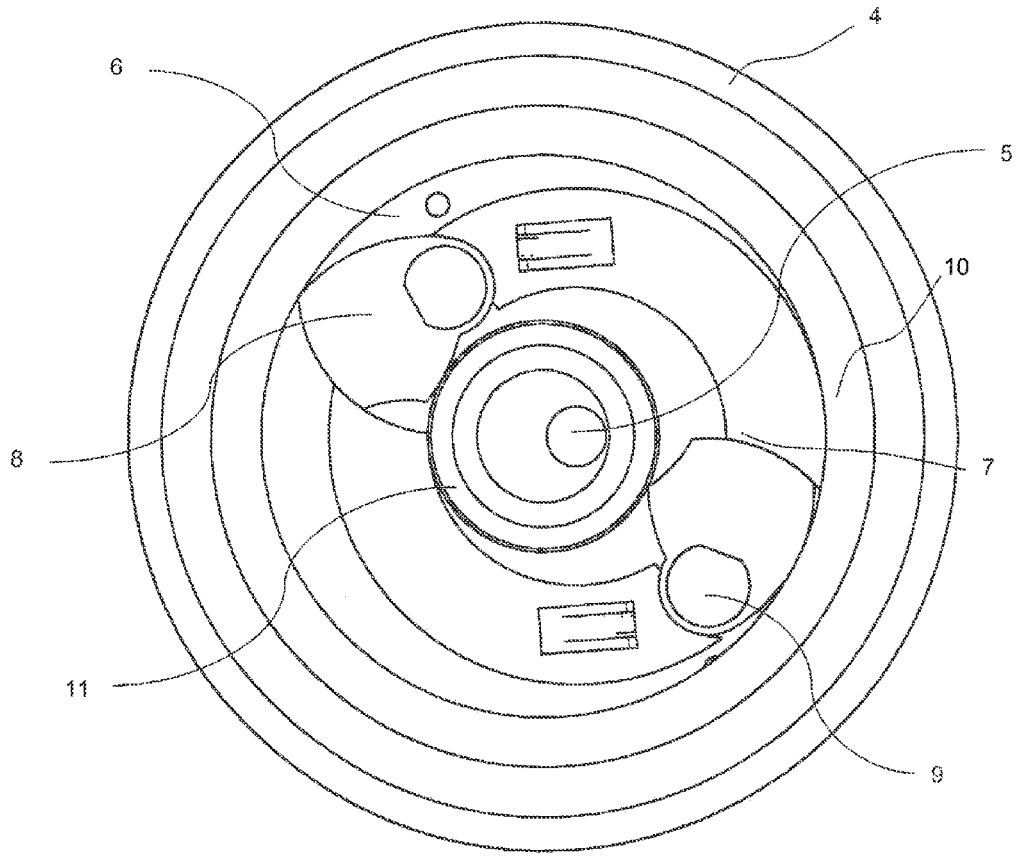
FIG. 12 shows a view of the crank assembly assembled inside the rotary engine at 0 degree position, in accordance to the present invention.
Figure 13:
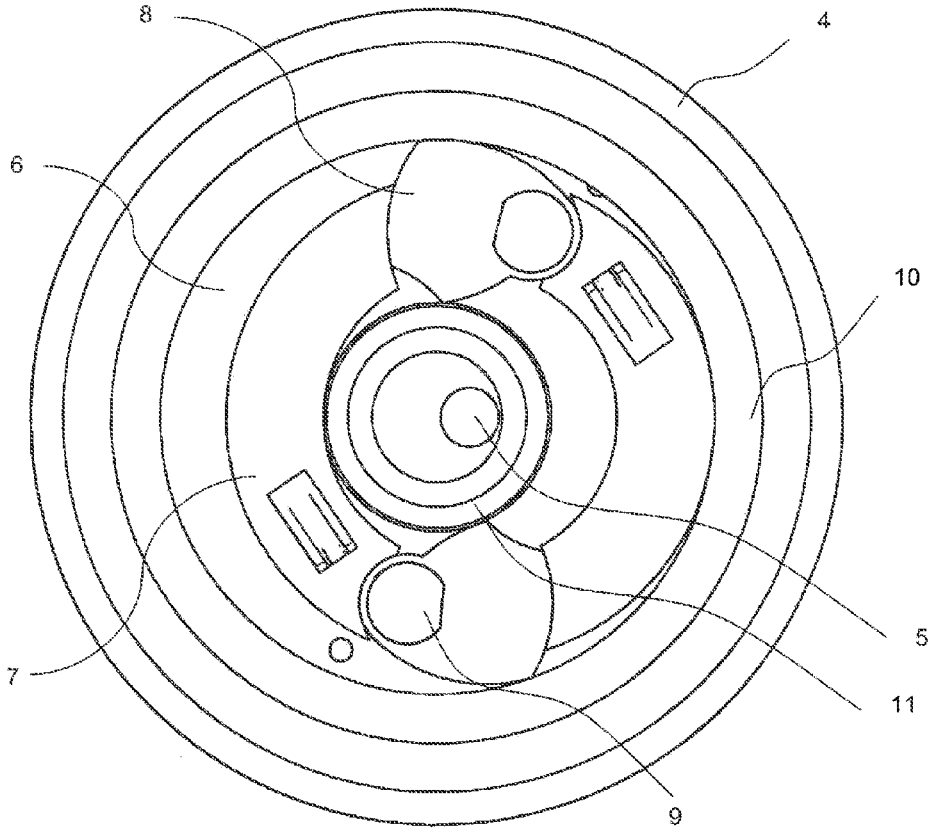
FIG. 13 shows a view of the crank assembly assembled inside the rotary engine at 60 degree position, in accordance to the present invention.
Figure 14:
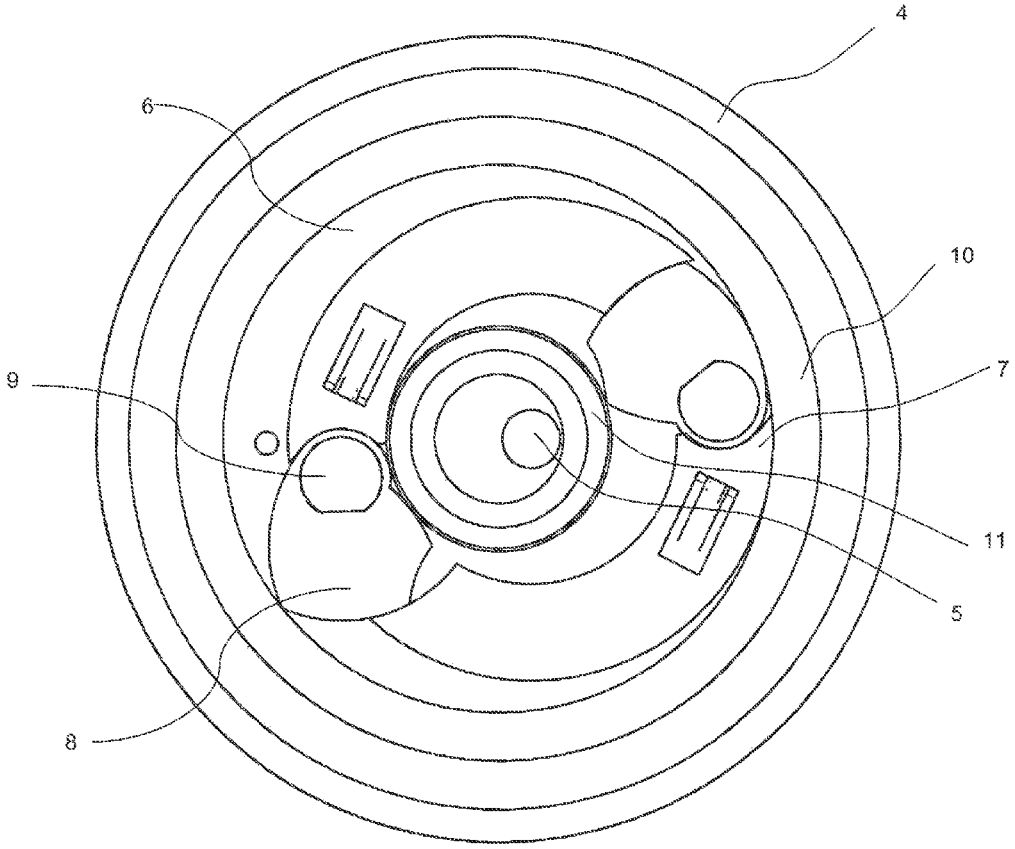
FIG. 14 shows a view of the crank assembly assembled inside the rotary engine at 120 degree position, in accordance to the present invention.

FIG. 12 to 14 shows a view of the crank assembly assembled inside the rotary engine at 0 degree, 60 degree and 120 degree of cam position, in accordance to the present invention. The actuation of the crank shall (5) draws the air through the suction port (2) in one compression chamber and the compressed air is transferred through the air paths (16) in the crank plate (6) and cranks (7) to the combustion chamber.

At the position of the cam assembly in 0 degree, the air is ready to draw inside the compression chamber. The rotation of the crank plate (6) and the actuation of the air and fire actuator (15) allow passing the compressed air to the air paths (16) in the crank plate (6). The air and fire actuator (15) is kept closed during this operation and hence the compressed air starts storing in the crank (7) and the crank plate (6). When the compression completes the compressed air is stored in the crank plate (6) and crank (7), with both the actuators (15) kept closed. The compression ratio can be adjusted by adjusting the air guide path (16) acting as air storage area in the crank plate (6).

At the position of the cam assembly in 60 degree, the air drawn inside the compression chamber is compressed. Upon further rotation, the crank (7) touches the inner cavity ring (11), and the air and fire actuator (15) is further actuated. The compressed air passes through the opening provided by the air and fire actuator (15) into the air path (16) in the crank plate (6) and further travels to the crank (7) through the square opening provided on top of the crank plate (6). The compressed air fuel mixture passes through the opening in air path (16) and reaches the combustion chamber and the charge is now is ready to be fired.

At the position of the cam assembly in 120 degree, the air drawn inside the compression chamber is fully compressed and transferred to the combustion chamber. Simultaneously the further rotation of the crank plate (6) actuates the air and fire actuator (15) and allows passing the compressed air to the combustion chamber through the air guide paths (16) in the crank plate (6) and the cranks (7). The spark plug provided under the cam on top of the crank plate (6) ignites the air fuel mixture as it passes through the ignition system in the bottom casing (4). When the combustion takes place the expansion of the firing pushes the cam (8) and the crank plate (6) is driven. The further rotation of the crank plate (6), the already burnt air in the combustion chamber is exhausted through the exhaust port (3) in the top housing (1).

The operation is designed to made cyclic, such that in the first half revolution of the crank plate, the suction and compression takes place in one compression chamber and firing and exhaust takes place in the other chamber of the same cam. After half revolution the following cam does the same operation. During the other half of the revolution, the compressed in the first compression chamber is transferred through to the respective combustion chamber through the air guide paths in the crank plate and the cranks. Simultaneously the air is drawn for compression in the other compression chamber is compressed within the half revolution of the crank plate. Thus the engine continuously run and completes the compression and combustion process through the outer compression chambers and the inner combustion chambers through the common suction and exhaust ports.

The crank assembly according to the present invention allows forming two outer compression chambers and two inner combustion chambers, thus within one revolution the engine completes two cycles or one cycle of operation is done within half the revolution. The opening and closing of the air paths are controlled by the air and fire actuator as it passes through the predetermined position in the bottom housing, thus the opening and closing of air paths can be easily controlled. The spark plug is configured to ignite the combustion chamber upon actuation of the air and fire actuator.

The improved crank and cam assembly according to the present invention enables to provide an improved rotary type internal combustion engine which address and overcomes the disadvantages of conventional engines. The rotary engine according to the present invention is simple and compact. This rotary type engine has single crank plate and a set of cranks arranged to produce two compression chambers and two combustion chambers, thus enabling the engine to complete two cycles within one revolution, and thereby improving the fuel efficiency and engine performance.

The rotary engine according to the present invention can be utilized as a petrol engine by placing the spark plugs in the crank plate and configuring the spark plugs to ignite the combustion chamber upon actuation of the air and fire actuators. This engine can be used as a diesel engine by replacing the sparks are with the fuel injectors. This rotary engine can be used as an air compressor by channelizing and storing the compressed from the compression chambers. Thus the rotary engine according to present invention can be adopted for petrol engine, diesel engine and as an compressor.

The foregoing description is a specific embodiment of the present invention. It should be appreciated that this embodiment is described for purpose of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

I claim:

1. A rotary internal combustion engine, comprising:

a top housing constructed with a suction port and an exhaust port, and a bottom housing arranged to receive a crank assembly and a cam assembly such that the crank assembly and the cam assembly are assembled in between the top housing and the bottom housing;

a crank rotatably placed above the bottom housing and a set of semi circular cranks provided at a top surface of the crank plate to travel along with the crank plate, wherein the set of semi circular cranks includes two semi circular cranks positioned opposite to each other and aligned to the crank plate and a crank shaft arranged to drive along with the crank plate;

wherein the cam assembly has a set of cams, each having radius on four sides and an air path on its bottom, placed above the crank plate and arranged to pivot through pivot pins, such that the set of cams and the set of semi circular cranks revolve to form an eccentricity with an outer cavity ring and an inner cavity ring;

the outer cavity ring is provided to surround the set of semi circular cranks above the crank plate and the inner cavity ring placed inside the set of semi circular cranks, wherein upon rotation of the crank plate and the set of semi circular cranks, two variable volume outer chambers are formed in between the set of semi circular cranks and the outer cavity ring, and two variable volume inner chambers are formed in between the set of semi circular cranks and the inner cavity ring, wherein a set of air guide paths are formed at the bottom of the crank plate and the set of semi circular cranks to communicate the two variable volume inner chambers and the two variable volume outer chambers.

2. The rotary internal combustion engine as claimed in claim 1, wherein each cam of the set of cams is placed in a bearing in the crank plate through a pivot, such that the set of cams oscillates on the surface of the crank plate guided by the set of semi circular cranks, and slides on the inner and outer cavity rings.

3. The rotary internal combustion engine as claimed in claim 1, wherein a set of air and fire actuators are arranged at the set of air guide paths to channelize compressed air to the two variable volume inner chambers, upon reaching a predetermined position.

4. The rotary internal combustion engine as claimed in claim 3, wherein each of the air and fire actuators is constructed as a v shaped block having a v joint and a roller pivoted at the v joint, such that upon reaching a predetermined position, the air and fire actuators are actuated and the air from the two variable volume outer chambers is transferred to the two variable volume inner chambers.

5. The rotary internal combustion engine as claimed in claim 4, wherein further rotation of the crank plate pushes the roller in the air and fire actuators and allows passing compressed air to the two variable volume inner chambers through the air paths in the crank plate, the set of semi circular cranks the set of cams and the pivot pins.

6. The rotary internal combustion engine as claimed in claim 3, wherein the rotation of the crank plate and the actuation of the air and fire actuators allow passing compressed air to the air guide paths in the crank plate.

7. The rotary internal combustion engine as claimed in claim 1, wherein the set of cams and the pivot pins are provided with grooved air paths to transfer received compressed air through the pivot pins.

8. The rotary internal combustion engine as claimed in claim 1, wherein the set of cams is arranged to oscillate through the pivot pins, and the pivot pins are supported from the crank plate.

9. The rotary internal combustion engine as claimed in claim 1, wherein each semi circular crank of the set of semi circular semi circular cranks includes an air path to communicate the two variable volume outer chambers ring to the two variable volume inner chambers.

10. The rotary internal combustion engine as claimed in claim 1, wherein each of the two variable volume outer chambers include compression chambers.

11. The rotary internal combustion engine as claimed in claim 1, wherein each of the two variable volume inner chambers include combustion chambers.

12. The rotary internal combustion engine as claimed in claim 1, wherein actuation of the crank shaft revolves the crank plate and draws air through the suction port into in one of the two variable volume outer chambers and proceeds to simultaneously compress the air drawn in the other of the two variable volume outer chambers.

13. The rotary internal combustion engine as claimed in claim 1, wherein compressed air in the two variable volume outer chamber is transferred through the air guide paths in the crank plate to the two variable volume inner chambers for ignition.

14. The rotary internal combustion engine as claimed in claim 1, wherein air enters into the two variable volume outer chambers through the suction ports provided in the top housing and the rotation of the crank plate and the cam compresses the air in the two variable volume outer chambers.

15. The rotary internal combustion engine as claimed in claim 1, wherein ignition in the two variable volume inner chambers delivers to drive the crank plate and the crank shaft, and further driving of the crank plate actuates the exhaust port to exhaust the combusted gases inside the two variable volume inner chambers.

16. The rotary internal combustion engine as claimed in claim 1, wherein the air guide paths formed at the bottom of the crank plate are sealed.

17. The rotary internal combustion engine as claimed in claim 1, wherein a set of spark plugs are provided at the two variable volume inner chambers through the crank plate or on the top housing to ignite the compressed charge inside the two variable volume inner chambers.

18. The rotary internal combustion engine as claimed in claim 1, wherein a set of fuel injectors are provided in the place of spark plugs to ignite the compressed air inside the two variable volume inner chambers.

* * * * *